US009009992B2

(12) United States Patent
Baker et al.

(10) Patent No.: US 9,009,992 B2
(45) Date of Patent: Apr. 21, 2015

(54) ARTICLE OF FOOTWEAR WITH A BALL CONTACTING MEMBER

(75) Inventors: Brian D. Baker, Portland, OR (US); Thomas G. Bell, Portland, OR (US); Daniel W. Peter, Portland, OR (US); Blake Rhulen, Portland, OR (US); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 439 days.

(21) Appl. No.: 13/048,006

(22) Filed: Mar. 15, 2011

(65) Prior Publication Data

US 2012/0233888 A1 Sep. 20, 2012

(51) Int. Cl.

| | |
|---|---|
| ***A43B 5/00*** | (2006.01) |
| ***A43B 23/00*** | (2006.01) |
| ***A43B 5/02*** | (2006.01) |
| ***A43B 23/02*** | (2006.01) |
| ***A43C 11/14*** | (2006.01) |
| ***A43C 11/24*** | (2006.01) |

(52) U.S. Cl.

CPC ..... *A43B 5/025* (2013.01); *A43B 23/0205* (2013.01); *A43B 23/0235* (2013.01); *A43C 11/1493* (2013.01); *A43C 11/24* (2013.01)

USPC ..... 36/133; 36/135; 36/136

(58) Field of Classification Search

CPC ..... A43B 23/02; A43B 5/00; A43B 13/12

USPC ..... 36/133, 135, 136, 99, 54

See application file for complete search history.

(56) References Cited

U.S. PATENT DOCUMENTS

| | | | | |
|---|---|---|---|---|
| 2,661,547 | A | | 12/1953 | Hyde et al. |
| 3,191,321 | A | | 6/1965 | Brutting |
| 3,650,051 | A | * | 3/1972 | Sass ..... 36/133 |
| 3,703,775 | A | | 11/1972 | Gatti |
| 4,422,249 | A | * | 12/1983 | Hannah ..... 36/133 |
| 4,610,102 | A | * | 9/1986 | Hill ..... 36/136 |
| 4,617,746 | A | * | 10/1986 | Hannah ..... 36/133 |
| 4,630,383 | A | * | 12/1986 | Gamm ..... 36/136 |
| 4,766,682 | A | * | 8/1988 | Malloy, III ..... 36/132 |
| 4,768,648 | A | * | 9/1988 | Glass ..... 206/38 |
| D299,884 | S | | 2/1989 | Brown et al. |
| 4,811,497 | A | | 3/1989 | Merino Ciudad |
| 4,823,426 | A | * | 4/1989 | Bragga ..... 15/210.1 |
| D304,128 | S | | 10/1989 | Kolman et al. |
| 4,967,493 | A | | 11/1990 | Mues |

(Continued)

FOREIGN PATENT DOCUMENTS

| | | | |
|---|---|---|---|
| CN | 1279588 | A | 1/2001 |
| CN | 2452332 | Y | 10/2001 |

(Continued)

OTHER PUBLICATIONS

International Search Report and Written Opinion mailed Sep. 4, 2012 in International Application No. PCT/US2012/027835.

(Continued)

*Primary Examiner* — Khoa Huynh
*Assistant Examiner* — Timothy K Trieu
(74) *Attorney, Agent, or Firm* — Plumsea Law Group, LLC

(57) ABSTRACT

An article of footwear with a ball contacting member is disclosed. The ball contacting member enhances the ability of a wearer to kick a ball with a low trajectory. The ball contacting member can be attached to the article of footwear in various different ways.

21 Claims, 10 Drawing Sheets

(56) References Cited

U.S. PATENT DOCUMENTS

| | | | | | |
|---|---|---|---|---|---|
| 5,127,170 | A | * | 7/1992 | Messina | 36/105 |
| 5,165,190 | A | * | 11/1992 | Smyth | 36/50.1 |
| 5,313,719 | A | | 5/1994 | Koethe | |
| 5,421,106 | A | | 6/1995 | Emrick | |
| 5,433,437 | A | | 7/1995 | Dudley | |
| 5,437,112 | A | * | 8/1995 | Johnston | 36/128 |
| 5,459,947 | A | * | 10/1995 | Lasher | 36/54 |
| 5,555,650 | A | | 9/1996 | Longbottom et al. | |
| D377,410 | S | | 1/1997 | Crowley | |
| 5,701,688 | A | | 12/1997 | Crowley | |
| 5,737,858 | A | | 4/1998 | Levy | |
| 5,894,685 | A | | 4/1999 | Yates | |
| 5,897,446 | A | | 4/1999 | Wiseman et al. | |
| 5,974,701 | A | * | 11/1999 | Busch | 36/138 |
| 6,038,792 | A | * | 3/2000 | Hauter | 36/133 |
| D433,212 | S | * | 11/2000 | Morle | D2/905 |
| 6,257,998 | B1 | * | 7/2001 | Ein-Gal | 473/518 |
| D456,121 | S | | 4/2002 | Smith, III | |
| 6,408,542 | B1 | | 6/2002 | Shepherd | |
| 6,421,936 | B1 | | 7/2002 | Gerrand | |
| RE37,887 | E | | 10/2002 | Yates | |
| 6,523,282 | B1 | | 2/2003 | Johnston | |
| D472,041 | S | | 3/2003 | Kuerbis | |
| 6,637,132 | B2 | * | 10/2003 | Gerrand | 36/133 |
| 6,681,503 | B2 | * | 1/2004 | Morle | 36/99 |
| 6,880,272 | B2 | * | 4/2005 | Wells | 36/138 |
| 6,886,275 | B1 | * | 5/2005 | Westfall | 36/133 |
| 6,971,192 | B2 | | 12/2005 | Shepherd | |
| 6,973,746 | B2 | | 12/2005 | Auger et al. | |
| 7,152,286 | B2 | * | 12/2006 | Rooney et al. | 24/712.6 |
| D551,431 | S | | 9/2007 | Tomat | |
| 7,392,603 | B1 | | 7/2008 | Shepherd et al. | |
| D581,635 | S | | 12/2008 | Hickman | |
| 7,487,605 | B2 | * | 2/2009 | Hatzilias | 36/133 |
| 7,721,470 | B2 | * | 5/2010 | Long | 36/136 |
| 7,941,943 | B2 | * | 5/2011 | Baker et al. | 36/54 |
| 8,109,013 | B2 | * | 2/2012 | Parrott | 36/72 R |
| 8,156,665 | B2 | * | 4/2012 | Shepherd et al. | 36/54 |
| 8,176,658 | B2 | * | 5/2012 | Katz | 36/100 |
| 8,196,320 | B2 | * | 6/2012 | Adami et al. | 36/100 |
| 8,196,321 | B2 | * | 6/2012 | Baker et al. | 36/133 |
| 8,196,322 | B2 | * | 6/2012 | Atsumi et al. | 36/133 |
| 8,356,429 | B2 | * | 1/2013 | Eder et al. | 36/133 |
| 2002/0029496 | A1 | * | 3/2002 | Morle | 36/99 |
| 2002/0043007 | A1 | | 4/2002 | Hannah | |
| 2003/0167658 | A1 | | 9/2003 | Davis | |
| 2004/0055183 | A1 | * | 3/2004 | Lee et al. | 36/128 |
| 2006/0101669 | A1 | | 5/2006 | Santos | |
| 2007/0227047 | A1 | | 10/2007 | Zaza | |
| 2010/0299961 | A1 | * | 12/2010 | Baker et al. | 36/94 |
| 2012/0233888 | A1 | * | 9/2012 | Baker et al. | 36/133 |

FOREIGN PATENT DOCUMENTS

| | | |
|---|---|---|
| EP | 0359081 | 3/1990 |
| JP | 09140402 | 6/1997 |
| NL | 1014898 | 10/2001 |
| WO | 9632856 | 10/1996 |
| WO | 2005107508 | 11/2005 |

OTHER PUBLICATIONS

International Preliminary Report on Patentability cited in PCT/US2012/027835 dated Sep. 17, 2013.

Response to International Search Report and Written Opinion filed May 9, 2014 in European Patent Application No. 12713424.5.

Office Action dated Feb. 3, 2015 in Chinese Patent Application No. 201280021371.7, and English translation thereof.

* cited by examiner

ARTICLE OF FOOTWEAR WITH A BALL CONTACTING MEMBER

BACKGROUND

The present invention relates generally to an article of footwear, and more particularly to an article of footwear including a ball contacting member.

There are many sports activities that include kicking a ball. Examples of such sports include soccer, football, rugby, Australian-rules football, and kickball. Conventional sports shoes that are available for these sports typically have an upper not very different from the uppers of other athletic shoes.

Features to optimize contact between the ball and shoe have been previously proposed. Hyde (U.S. Pat. No. 2,661,547) teaches a concave attachment to a shoe providing a pocket on the top of the foot to receive a football when it is kicked. Hannah (U.S. Pat. Nos. 4,422,249 and 4,617,746) and Gerrand (U.S. Pat. Nos. 6,421,936 and 6,637,132, and WO 2005/107508 A1) teach shoes having surfaces to optimize kicking of a ball.

SUMMARY OF THE INVENTION

In one aspect, the invention provides an article of footwear, comprising: an upper including a forefoot portion, a heel portion and a midfoot portion disposed between the forefoot portion and the heel portion; a ball contacting member disposed on the upper of the article of footwear, the ball contacting member including a first end portion and a second end portion, the second end portion being closer to the heel portion of the upper than the first end portion; the second end portion being thicker than the first end portion; and wherein the ball contacting member includes an interior portion extending between an upper surface of the ball contacting member and an exterior surface of the upper and wherein the interior portion comprises a substantially continuous material.

In another aspect, the invention provides an upper including an exterior surface; a ball contacting member in contact with the exterior surface of the upper; a lower planar surface that is approximately parallel with a lower surface of the article of footwear; an upper surface of the ball contacting member forming a first angle with the lower planar surface; the exterior surface of the upper forming a second angle with the lower planar surface; and wherein the first angle is substantially greater than the second angle.

In another aspect, the invention provides an article of footwear, comprising: a ball contacting member configured to attach to an upper of the article of footwear, the ball contacting member being disposed on an exterior surface of the upper; the ball contacting member including an upper surface configured to contact a ball being kicked by a wearer of the article of footwear; and; wherein a trajectory of a ball kicked using the ball contacting member is lower than a trajectory of the ball kicked using the exterior surface of the upper.

Other systems, methods, features and advantages of the invention will be, or will become apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE EMBODIMENTS

Figure 1:
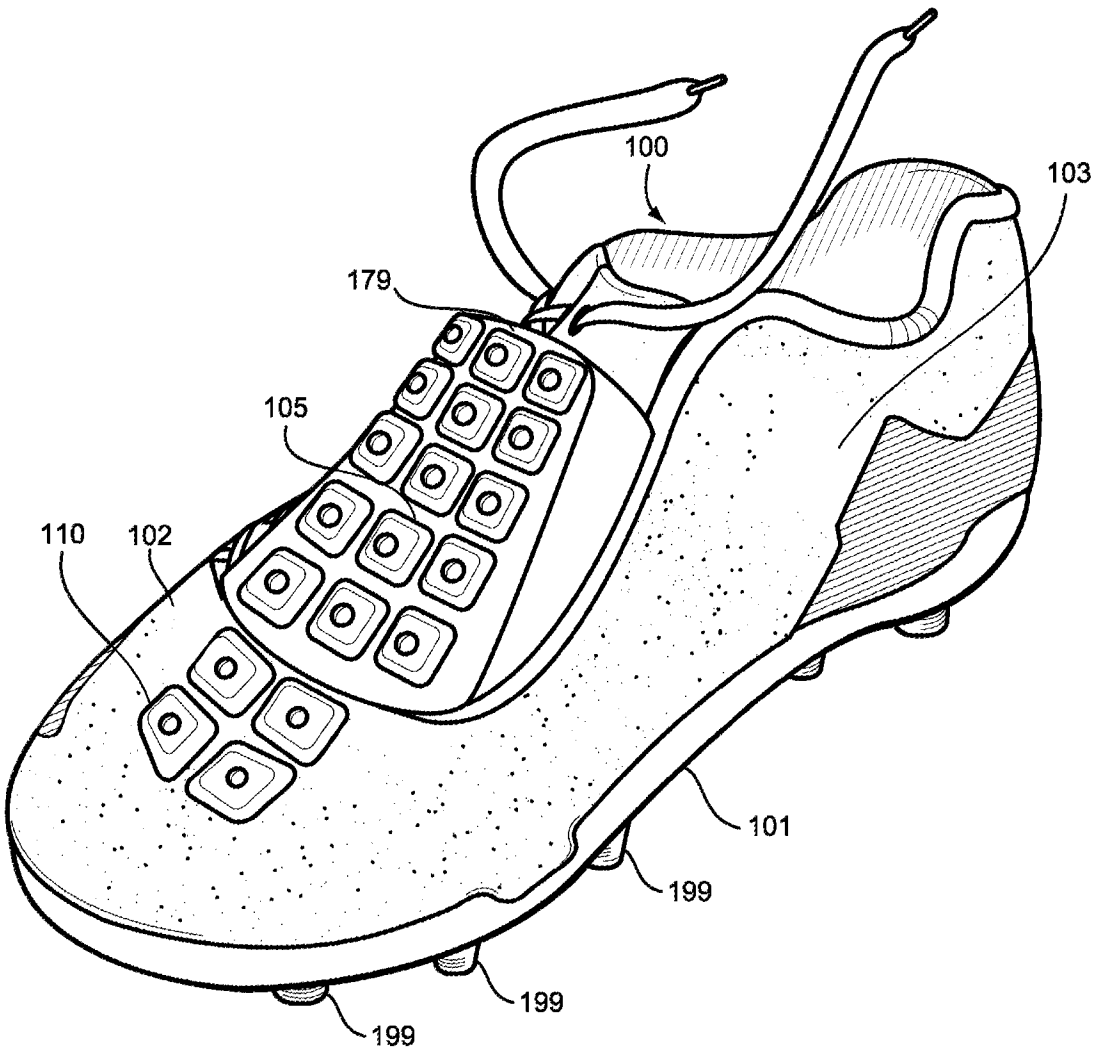
FIG. 1 is an isometric view of an embodiment of an article of footwear including a ball contacting member.

FIGS. 1 through 4 illustrate views of an embodiment of article of footwear 100. For clarity, the following detailed description discusses an embodiment, in the form of a shoe for indoor soccer, but it should be noted that the present invention could take the form of any article of footwear including, but not limited to, soccer shoes, football shoes, rugby shoes, as well as other kinds of shoes.

Referring to FIGS. 1 through 4, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot portion 10, midfoot portion 12 and heel portion 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. It will be understood that each of these directional adjectives may be applied to individual components of an article, such as an upper and/or a sole structure.

Article of footwear 100, also referred to as simply article 100, may include upper 102 and sole structure 101. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. Generally, upper 102 may be made from any suitable material, including but not limited to, for example, nylon, natural leather, synthetic leather, natural rubber, or synthetic rubber. In some cases, upper 102 can be made of any suitable knitted, woven or non-woven material.

In some embodiments, sole structure 101 may be configured to provide traction for article 100. In addition to providing traction, sole structure 101 may attenuate ground reaction forces when compressed between the foot and the ground during walking, running or other ambulatory activities. The configuration of sole structure 101 may vary significantly in different embodiments to include a variety of conventional or non-conventional structures. In some cases, the configuration of sole structure 101 can be configured according to one or more types of ground surfaces on which sole structure 101 may be used. Examples of ground surfaces include, but are not limited to: natural turf, synthetic turf, dirt, as well as other surfaces.

Sole structure 101 is secured to upper 102 and extends between the foot and the ground when article 100 is worn. In different embodiments, sole structure 101 may include different components. For example, sole structure 101 may include an outsole, a midsole, and/or an insole. In some cases, one or more of these components may be optional. Sole structure 101 may be made from any suitable material, including but not limited to elastomers, siloxanes, natural rubber, other synthetic rubbers, aluminum, steel, natural leather, synthetic leather, or plastics.

In some embodiments, sole structure 101 may include cleat members 199 that can enhance traction with the ground. In one embodiment, sole structure 101 includes cleat members 199 that are incorporated into sole structure 101. However, other embodiments may include removable cleat members. In one embodiment, sole structure 101 may use one or more features described in U.S. Pat. No. 6,973,746 to Auger et al, the entirety of which is incorporated by reference. In one embodiment, the cleat assembly described in U.S. Pat. No. 6,973,746 is used in combination with article 100.

Article 100 can include vamp portion 120. The term "vamp portion" as used throughout this detailed description and in the claims generally refers to a portion of upper 102 extending through forefoot portion 10 and midfoot portion 12. Vamp portion 120 may extend to entry hole 108 of upper 102. Additionally, in some cases, article 100 can include tongue 107 that extends from entry hole 108 into forefoot portion 10.

Figure 2:
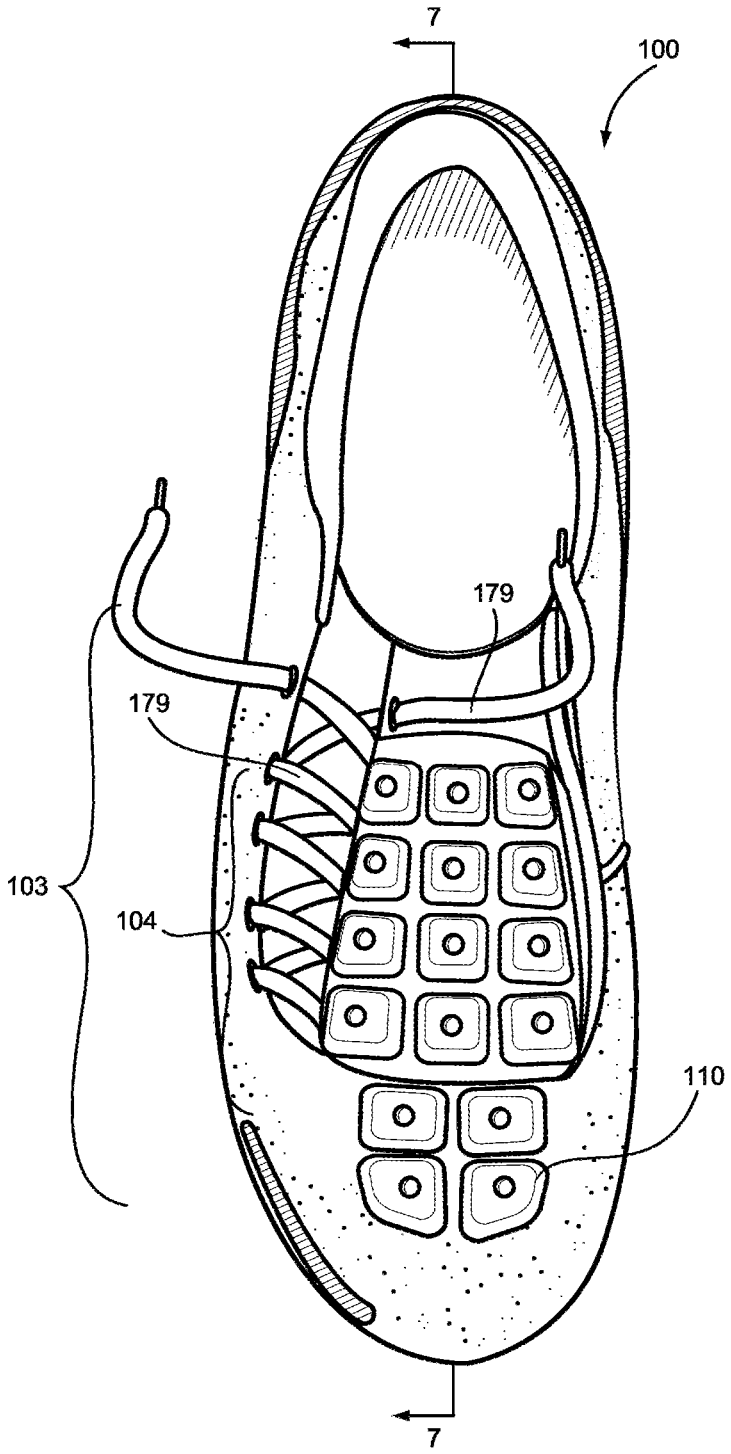
FIG. 2 is a plan view of an embodiment of an article of footwear including a ball contacting member.

In some embodiments, upper 102 may include shoe fastening system 103 (see FIG. 2). Shoe fastening system 103 may be used to tighten upper 102 to a foot. Examples of shoe fastening systems include, but are not limited to, laces, buckles, hook and loop fasteners (such as Velcro®) as well as any other types of fastening systems. In one embodiment, shoe fastening system 103 includes lace 179. Additionally, shoe fastening system 103 may include lacing portion 104. Lacing portion 104 may be a gap or opening in upper 102 that extends from entry hole 108 into forefoot portion 10. In this embodiment, lace 179 may be configured to change the size of lacing portion 104, which may further adjust the size of upper 102. In an exemplary embodiment, lacing portion 104 may be laterally spaced from the center of article 100. Using this laterally spaced lacing configuration, shoe fastening system 103 is designed to avoid interference with a ball that may be kicked using vamp portion 120 of upper 102.

Article of footwear 100 can include provisions for lowering the trajectory of a kicked ball. In some embodiments, article of footwear 100 may provide a kicking surface that is substantially inclined with respect to an outer portion of a shoe where a ball may contact an article during various types of kicks. In one embodiment, article 100 can include a wedge-shaped ball contacting member that provides a relatively steep angle for contact with a ball. This configuration may be useful in indoor soccer where the top of the goal is lower than the top of the goal in outdoor soccer, requiring lower trajectories for kicks.

In some embodiments, article 100 may also include provisions for enhancing the ability to contact and control the ball when kicked. In some cases, article 100 can include ball contacting member 105. Ball contacting member 105 may be any member configured to come in contact with a ball during various types of kicks.

Generally, ball contacting member 105 may be associated with any portion of upper 102. In some cases, ball contacting member 105 can be associated with forefoot portion 10 of upper 102. In other cases, ball contacting member 105 can be associated with midfoot portion 12 of upper 102. In an exemplary embodiment, ball contacting member 105 can be associated with vamp portion 120 of upper 102. Furthermore, in some cases, ball contacting member 105 may be disposed on a portion of upper directly above the instep, or top, of a foot.

Ball contacting member 105 may include upper surface 106. Upper surface 106 may be configured to contact a ball and may be generally oriented outwardly from upper 102. In addition, ball contacting member 105 may include first end portion 180 and second end portion 182. First end portion 180 may be disposed in forefoot portion 10, while second end portion 182 may be disposed in midfoot portion 12. In particular, second end portion 182 may be disposed closer to heel portion 14 than first end portion 180. In some cases, second end portion 182 may be disposed adjacent to entry hole 108, while first end portion 180 may be disposed adjacent to toe portion 115 of upper 102. With this arrangement, ball contacting member 105 may extend through a substantial majority of the length of vamp portion 120. In other embodiments, however, both first end portion 180 and second end portion 182 may be disposed in midfoot portion 12. In still other cases, first end portion 180 and second end portion 182 could be disposed in any other portions of article 100.

In some embodiments, ball contacting member 105 may include provisions for increasing the grip of upper surface 106. In some embodiments, ball contacting member 105 may include a ball control surface disposed along upper surface 106 of ball contacting member 105. In one embodiment, ball contacting member 105 may include first set of gripping members 110. In some cases, first set of gripping members 110 comprise raised portions of ball contacting member 105. First set of gripping members 110 may be designed to make initial contact with a ball before upper surface 106.

In some embodiments, first set of gripping members 110 may be disposed uniformly along upper surface 106. In other embodiments, first set of gripping members 110 may be distributed in a non-uniform manner on upper surface 106. In different embodiments, first set gripping members 110 may vary in size, height, and/or shape. First set of gripping members 110 may be formed in various shapes, including but not limited to circles, squares, rectangles, diamonds, ovals, stars, as well as other shapes. Generally, first set of gripping members 110 may be any desired size and may be spaced apart by intervals of varying distances. In some cases, first set of gripping members 110 may be sized and located so that the contact area between first set of gripping members 110 and a ball may be optimized. First set of gripping members 110 may be constructed in the shape of a manufacturer's logo, an athletic team's logo, or other kinds of patterns. It will also be understood that gripping members may be optional. In yet another embodiment, for example, upper surface 106 of ball contacting member 105 may be smooth.

In some embodiments, ball contacting member 105 may stop short of covering toe portion 115 of article 100 in order to allow flexing of the toes of a wearer. In some cases, to enhance grip at toe portion 115, upper 102 can include additional gripping members associated with toe portion 115. In the current embodiment, upper 102 can include second set of gripping members 112. In particular, second set of gripping members 112 can comprise substantially similar gripping members to the gripping members of first set of gripping members 110. With this arrangement, second set of gripping members 112 may be located on an upper surface 113 of toe portion 115 of article 100 in order to extend the ball control surface past the end of ball contacting member 105. It will be understood that gripping members on toe portion 115 of article 100 may be permanently installed or removable. Furthermore, in still other embodiments, ball contacting member 105 may extend over toe portion 115.

In different embodiments, the number of gripping members in first set of gripping members 110 and/or second set of gripping members 112 can vary. In some cases, first set of gripping members 110 can comprise between 1 and 30 gripping members. In other cases, first set of gripping members 110 can include more than 30 gripping members. In the current embodiment, first set of gripping members 110 may include 15 gripping members. Also, in some cases, second set of gripping members 112 can include between 1 and 10 gripping members. In other cases, second set of gripping members 112 can include more than 10 gripping members. In the current embodiment, second set of gripping members 112 can include 4 gripping members.

In many cases, a gripping system may include provisions that provide the wearer with the ability to apply different types of spin. In some embodiments, an article of footwear may include gripping members with multiple surface orientations. Generally, elevated gripping members may be provided with surface orientations that maximize the contact area between the gripping members and the ball. In some cases, these gripping member surfaces may be oriented to provide enhanced control of spin during kicking. In particular, multiple surface orientations may be provided for enhanced control of spin with each surface orientation associated with a certain type of kick or spin.

In some embodiments, gripping members may include provisions that help to increase friction or grip between the gripping member and a ball. These provisions may include features disposed on the upper surfaces of the gripping members. In some cases, the upper surfaces of the gripping members may be roughened, cut or include channels or grooves. It is also possible to provide protrusions or small projections on the upper surfaces of the gripping members. These various features can, in some cases, help to improve friction or grip between the gripping member and a ball. Some of these features are particularly helpful in adverse playing conditions. For example, a roughened outer surface, or an outer surface with grooves may help to improve friction during wet or rainy conditions. The upper surface features for the gripping members can be selected according to player preference or to match a certain playing condition.

In different embodiments, gripping members of first set of gripping members 110 and second set of gripping members 112 can have any type of surface features. In one embodiment, each gripping member of first set of gripping members 110 and second set of gripping members 112 can include recesses 111. In some cases, recesses 111 may provide enhanced grip between ball contacting member 105 and a ball. In other embodiments, it is also possible to independently arrange the upper surface feature of each gripping member. In other words, different gripping members on the same article may have different upper surface features.

Figure 3:
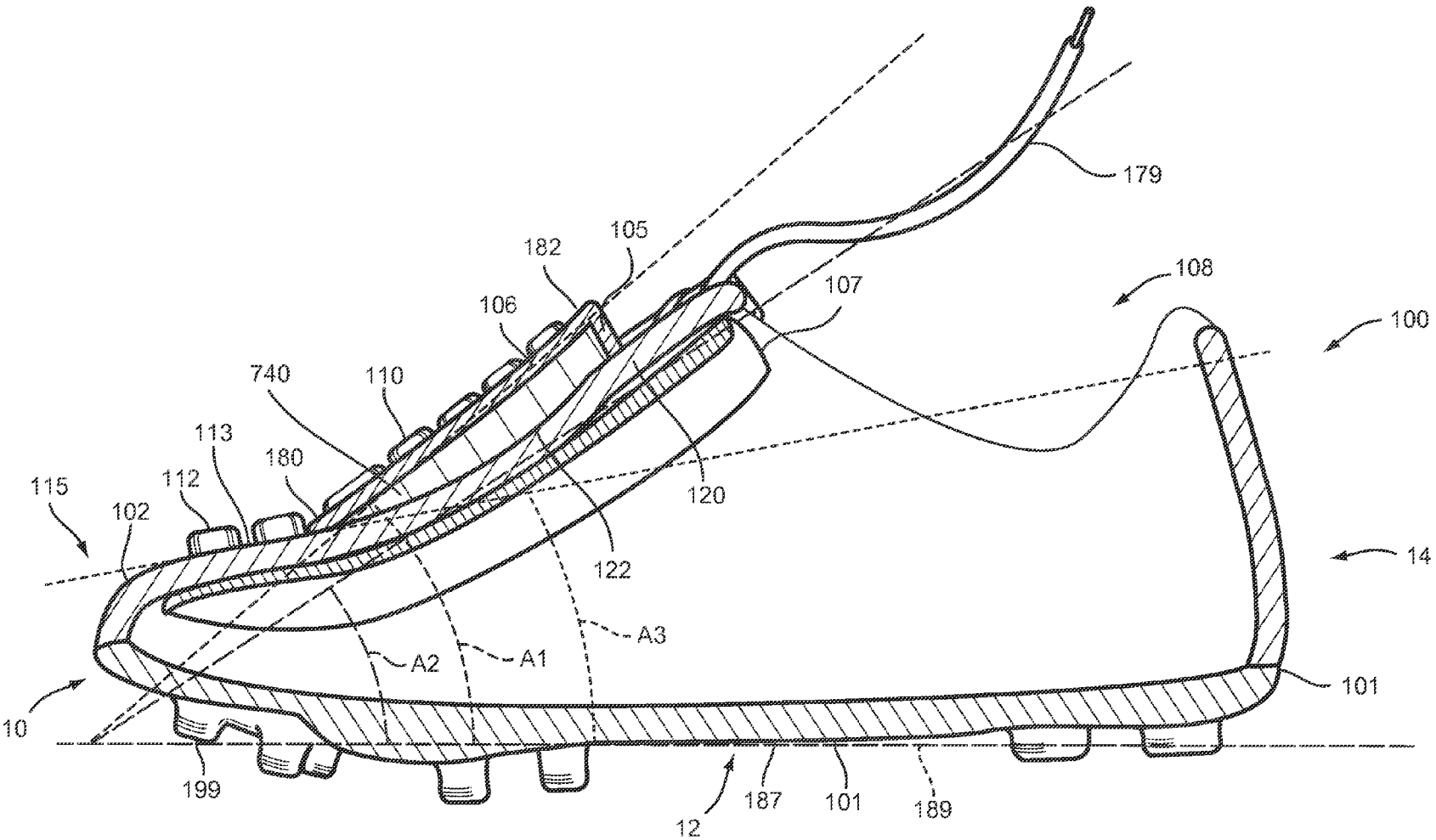
FIG. 3 is a longitudinal cross sectional view of the article of footwear of FIG. 2 taken through the lateral midline 3-3 of the article of footwear of FIG. 2.
Figure 4:
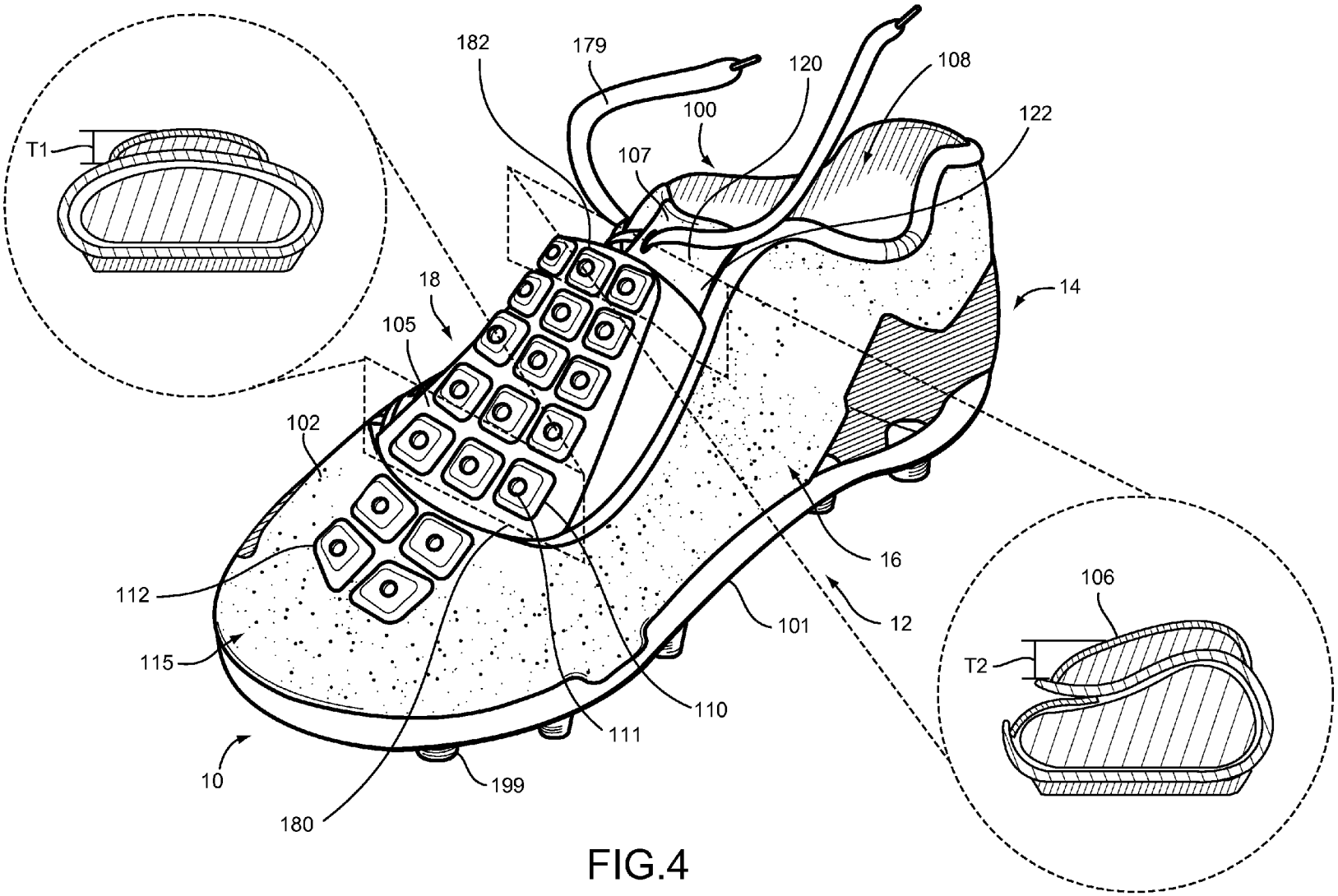
FIG. 4 is an isometric view of an embodiment of an article of footwear including a ball contacting member.

Referring now to FIGS. 3 and 4, in different embodiments, the geometry of ball contacting member 105 can vary. In some cases, ball contacting member 105 has a wedge-like shape that provides an angled surface for contacting a ball during a kick. In particular, in some cases, the thickness of ball contacting member 105 may vary from first end portion 180 of ball contacting member 105 to second end portion 182 of ball contacting member 105. In an exemplary embodiment, ball contacting member 105 may have thickness T1 at first end portion 180 and thickness T2 at second end portion 182 (see FIG. 4). Moreover, thickness T2 may be substantially greater than thickness T1. This arrangement may provide a substantially inclined configuration for upper surface 106. In particular, upper surface 106 may be inclined at a greater angle than exterior surface 122 of upper 102. In some cases, exterior surface 122 is a surface associated with a portion of vamp portion 120. In some cases, exterior surface 122 may be associated with a portion of upper 102 that is disposed above the instep, or top, of a foot.

For purposes of describing the relative inclinations of upper surface 106 and exterior surface 122, a lower planar surface 189 is described and shown. Lower planar surface 189 is a planar surface that is approximately parallel with lower surface 187 of sole structure 101. In some cases, lower planar surface 189 could be approximately parallel with any lower surface of article 100. In cases where an article is disposed on a ground surface, lower planar surface 189 may be approximately parallel with the ground surface.

In the current embodiment, upper surface 106 is inclined at angle A1 with respect to lower planar surface 189. In addition, exterior surface 122 of upper 102 is inclined at angle A2 with respect to lower planar surface 189 and upper surface 113 of toe portion 105 of upper 102 is inclined at angle A3 with respect to lower planar surface 189. In the current embodiment, angle A1 is substantially greater than angle A2. In other words, upper surface 106 is substantially steeper than exterior surface 122. This arrangement may provide a relatively steep contact angle between upper surface 106 of ball contacting member 105 and a ball that helps a user impart a lower trajectory to the ball during a kick. It will be understood that in other embodiments, angle A1 could be substantially equal to angle A2. In still other embodiments, angle A1 could be substantially less than angle A2. In addition, in the current embodiment, angle A2 is greater than angle A3 and angle A1 is substantially greater than angle A3. As shown in FIG. 3, the first set of gripping members 110 is aligned along angle A1 of upper surface 106 and the second set of gripping members 112 is aligned along angle A3 of upper surface 113, such that the first set of gripping members 110 is at an angle to the second set of gripping members 112.

In some embodiments, ball contacting member 105 may be installed on article of footwear 100 in such a way that there is no gap between a lower surface of ball contacting member 105 and vamp portion 120 of article of footwear 100. Such a gap may dissipate energy that could otherwise be applied to a kicked ball. A gap may also reduce the ability of a user to sense the contact between ball contacting member 105 and the kicked ball.

Referring to FIG. 3, in some embodiments, ball contacting member 105 can include interior portion 740. In some cases, interior portion 740 may comprise a substantially continuous material that extends between upper surface 106 and exterior surface 122 of upper 102. In one embodiment, interior portion 740 can be made of a first material and upper surface 106 can be made of a second material. In some cases, the first material can be substantially similar to the second material. For example, in one embodiment, ball contacting member 105 can comprise a substantially monolithic portion. In other cases, however, the first material and the second material may be substantially different. For example, in one embodiment, the first material may be a substantially less rigid material than the second material in order to cushion the foot of the wearer, but still provide a relatively firm striking surface to a ball. In another embodiment, the first material can be substantially more rigid than the second material. In one embodiment, the first material and the second material can be elastomeric materials of differing rigidities.

Alternatively, in some cases, interior portion 740 of ball contacting member 105 may be a hollow portion filled with a fluid of some kind. In particular, in some cases, interior portion 740 may be filled with air having a pressure higher than atmospheric pressure to reduce weight of the article of footwear 100 while preserving the firmness of the striking surface. In some cases, interior portion 740 of wedge-shaped device may further be divided into multiple air-filled compartments that can be pumped to any desired pressure by a user to provide variability in the firmness of the striking surface. In addition, allowing a user to adjust the pressure of interior portion 740 can allow the user to adjust the angle of ball contacting member 105 in order to change the arc of a kicked ball.

Referring now to FIG. 4, in different embodiments, the geometry of upper surface 106 of ball contacting member 105 may vary. In some cases, upper surface 106 may be a substantially flat surface. In other cases, upper surface 106 may be a substantially curved surface. Moreover, in some cases, upper surface 106 could be a concave surface. In still other cases, upper surface 106 could be a convex surface. In the exemplary embodiment, upper surface 106 may be a substantially convex surface. In particular, upper surface 106 may have a substantially convex shape along a lateral direction of article of footwear 100. For example, in the current embodiment, upper surface 106 has a substantially convex shape at second end portion 182. This generally convex arrangement may provide for a more naturally contoured kicking surface.

Figure 5:
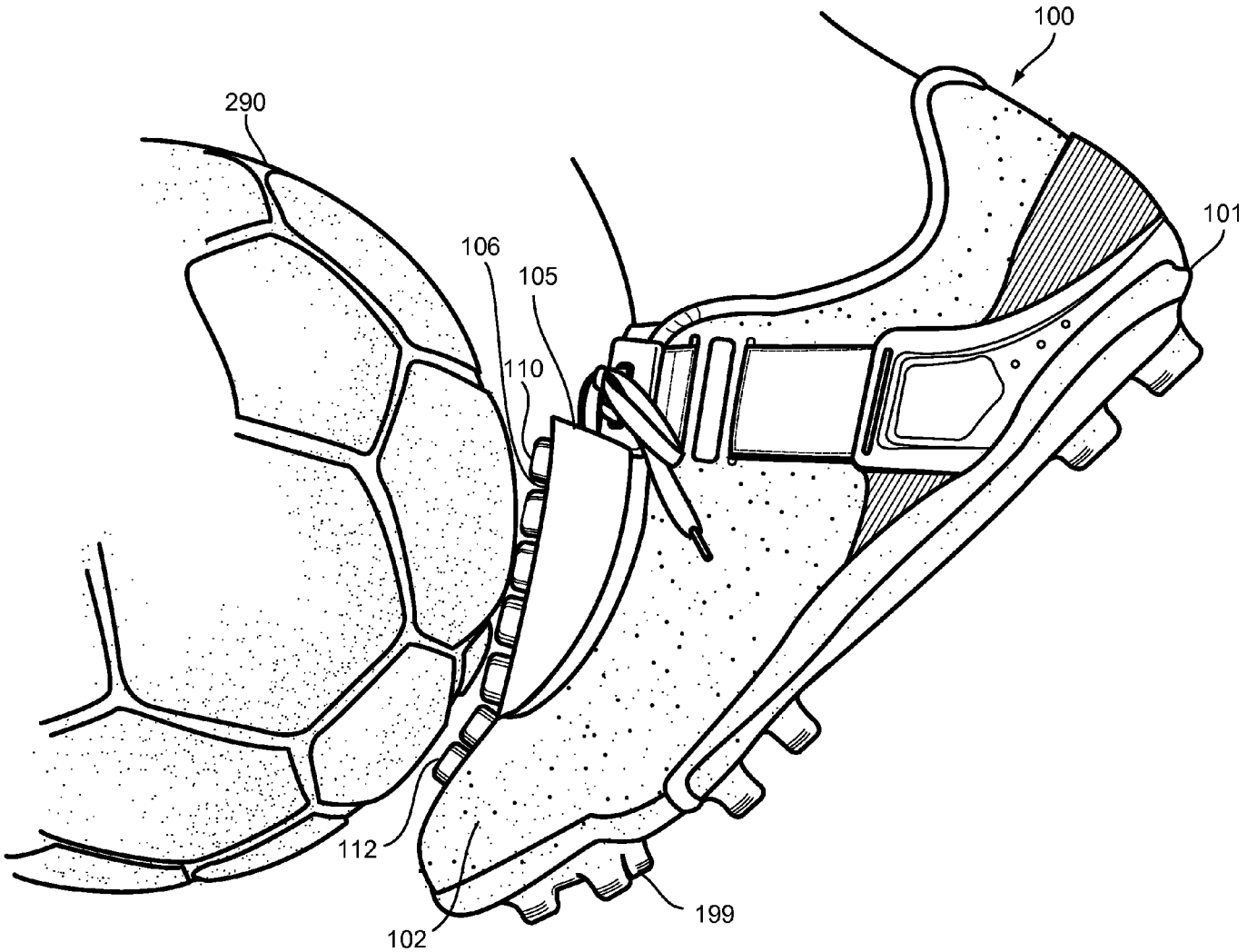
FIG. 5 is a side view of an embodiment of a ball contacting member in contact with a ball.

FIG. 5 illustrates the orientation of ball contacting member 105 at an exemplary location for transferring force to a ball during kicking. In FIG. 5, which is a schematic side view, article 100 is contacting ball 290. First set of gripping members 110 is disposed on upper surface 106 of ball contacting member 105 and second set of gripping members 112 is disposed on upper surface 113 of toe portion 115 in a manner that maximizes the contact area with ball 290. The large contact area may facilitate increased friction between ball 290 and article 100. With this arrangement, an inclined configuration of upper surface 106 may help impart a relatively low trajectory to ball 290.

Although the exemplary embodiment illustrates a substantially convex upper surface for ball contacting member 105, other embodiments could include any other shape for a ball contacting member. For example, in another embodiment, illustrated in FIG. 6, article of footwear 100 may include ball contacting member 205. In this case, ball contacting member 205 includes substantially flat upper surface 206. In particular, lateral side portion 220 of ball contacting member 205 may be substantially thicker than medial side portion 222 of ball contacting member 205 to accommodate the contoured shape of foot 250.

Figure 6:
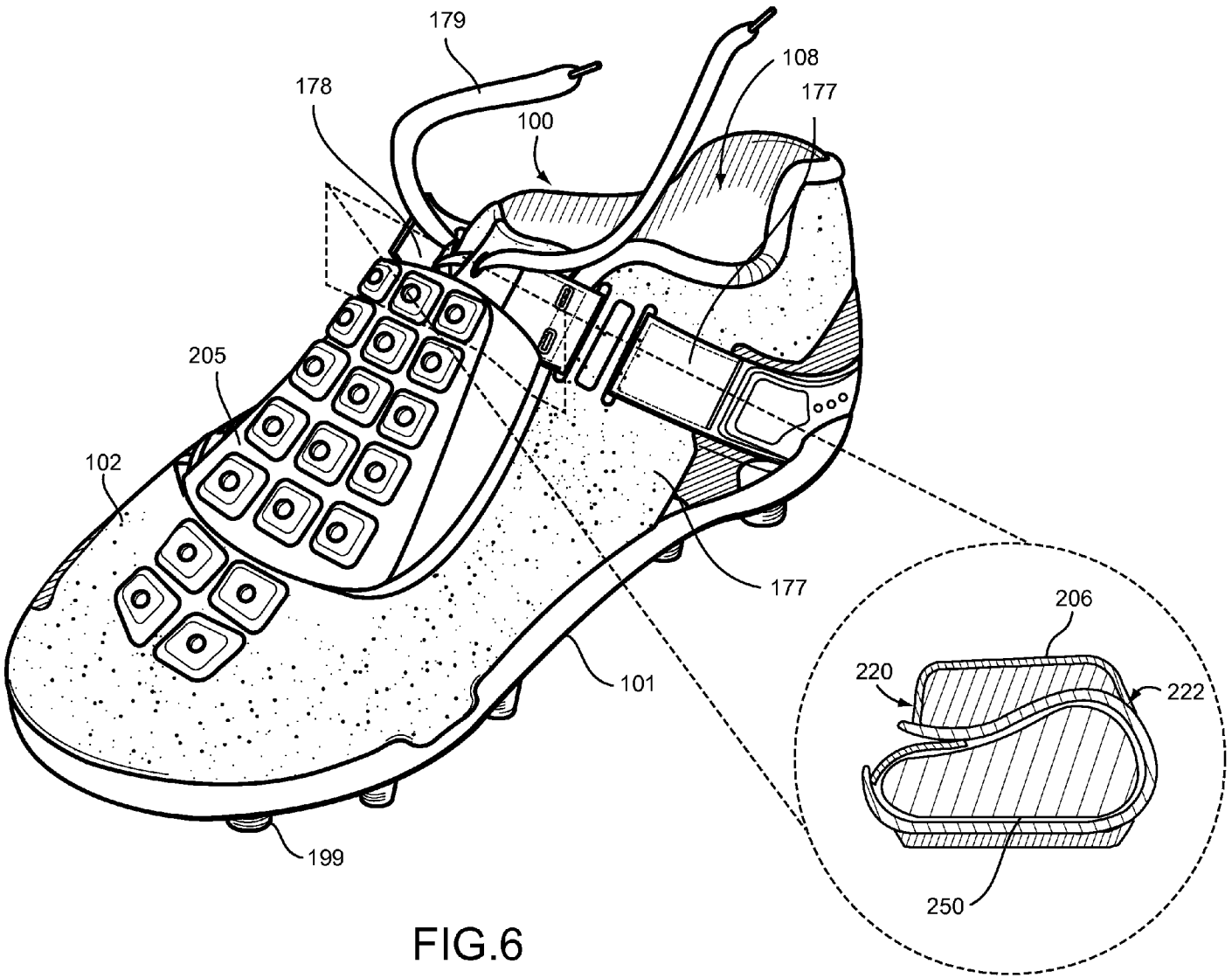
FIG. 6 is an isometric view of another embodiment of an article of footwear with a ball contacting member.

As illustrated in FIG. 6, article 100 may also include additional provisions for securing upper 102 to a foot. In some cases, for example, article 100 can include one or more straps. In the current embodiment, article 100 may include first strap 177 and second strap 178. In some cases, first strap 177 and second strap 178 may provide additional tensioning for upper 102 near entry hole 108. Furthermore, in some cases, first strap 177 and second strap 178 can be configured to engage lace 179 for fastening upper 102.

In some embodiments, a ball contacting member can be curved along a longitudinal direction. In other words, the thickness of a ball contacting member can vary in a nonlinear manner in the longitudinal direction. In some cases, a ball contacting member can have a substantially concave shape in a longitudinal direction in a manner that corresponds to the natural curvature of a ball. In other cases, a ball contacting member can have a substantially convex shape in a longitudinal direction.

Figure 7:
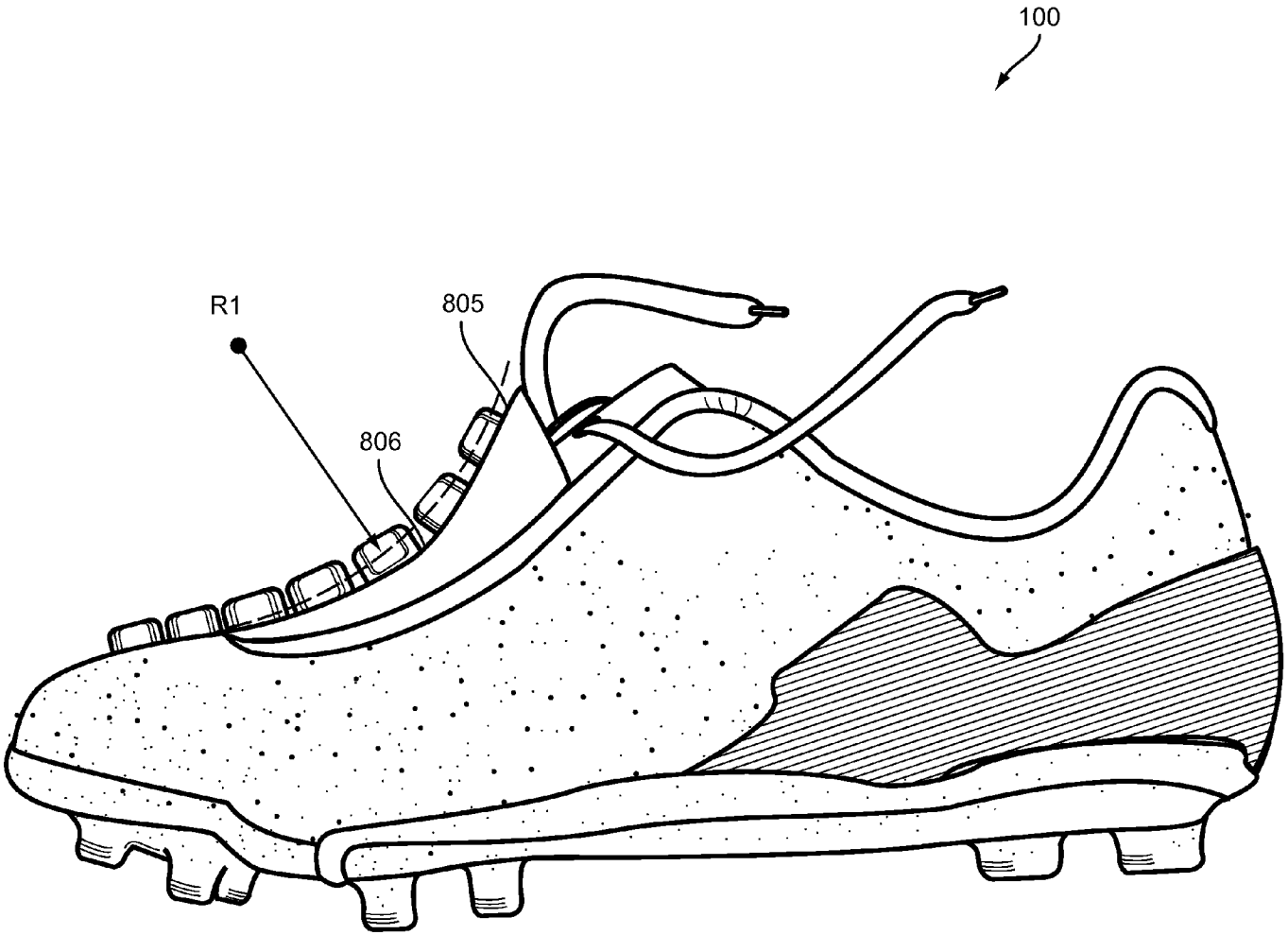
FIG. 7 is a side view of another embodiment of an article of footwear with a ball contacting member.

FIG. 7 illustrates another embodiment of article 100 including ball contacting member 805. In this case, ball contacting member 805 includes upper surface 806 that is substantially curved in the longitudinal direction. Moreover, in the current embodiment, upper surface 806 has a substantially concave shape. In some cases, upper surface 806 may be associated with a radius of curvature R1. In some cases, radius of curvature R1 may be substantially similar to the curvature of a ball. In other cases, radius of curvature R1 may be substantially greater than the curvature of a ball. In still other cases, radius of curvature R1 may be substantially less than the curvature of a ball. This arrangement may present a contoured upper surface for enhancing grip with a ball during kicks.

Generally, a ball contacting member can be attached to an article of footwear in any manner. In a previously described embodiment, ball contacting member 105 may be permanently installed on vamp portion 120 of article of footwear 100 (see FIG. 1). Alternatively, in another embodiment, a ball contacting member may be removably installed on article of footwear 100 using any method of attachment known in the art including, but not limited to, laces, buckles, or Velcro®.

Figure 8:
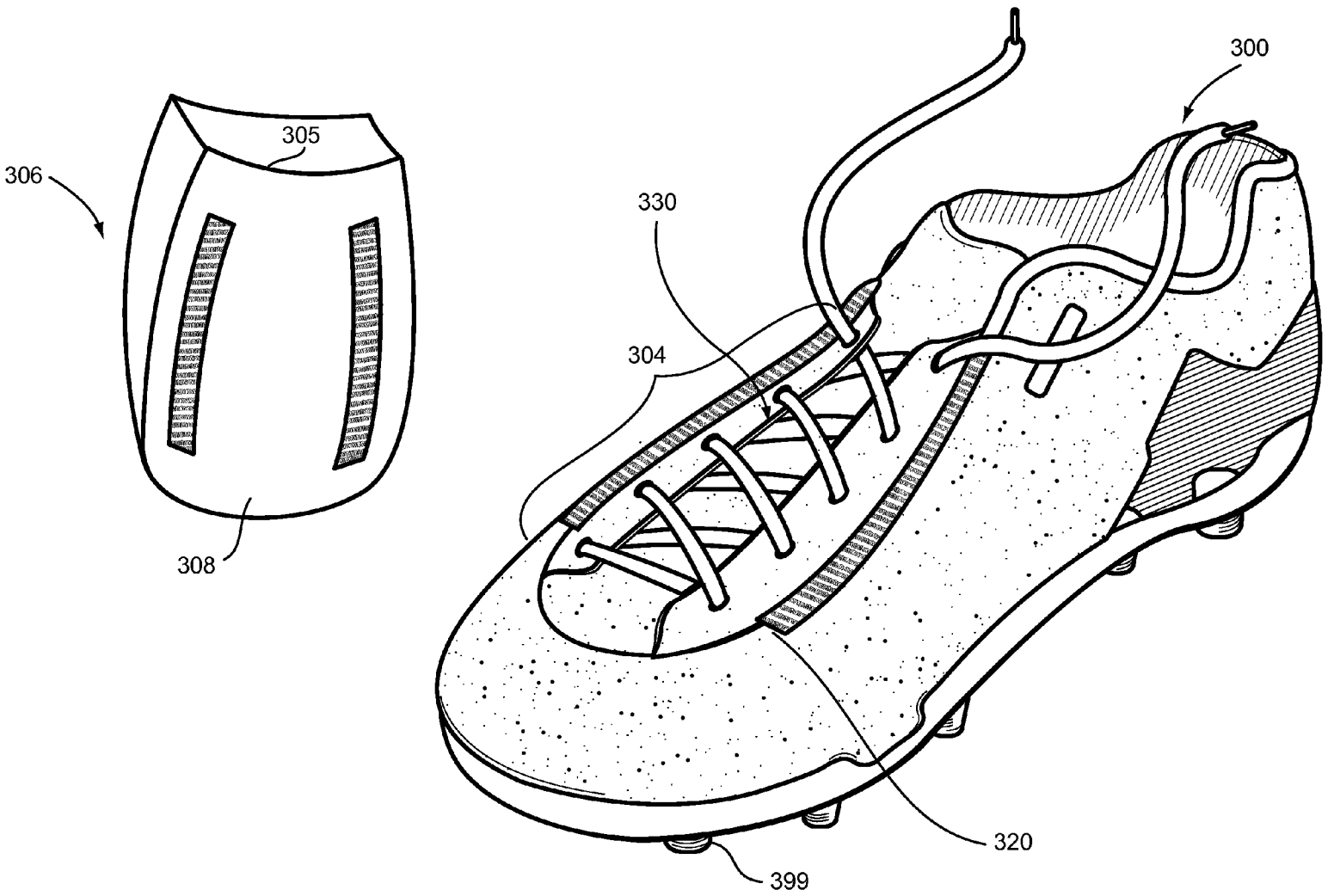
FIG. 8 is an isometric view of another embodiment of an article of footwear with a ball contacting member.
Figure 9:
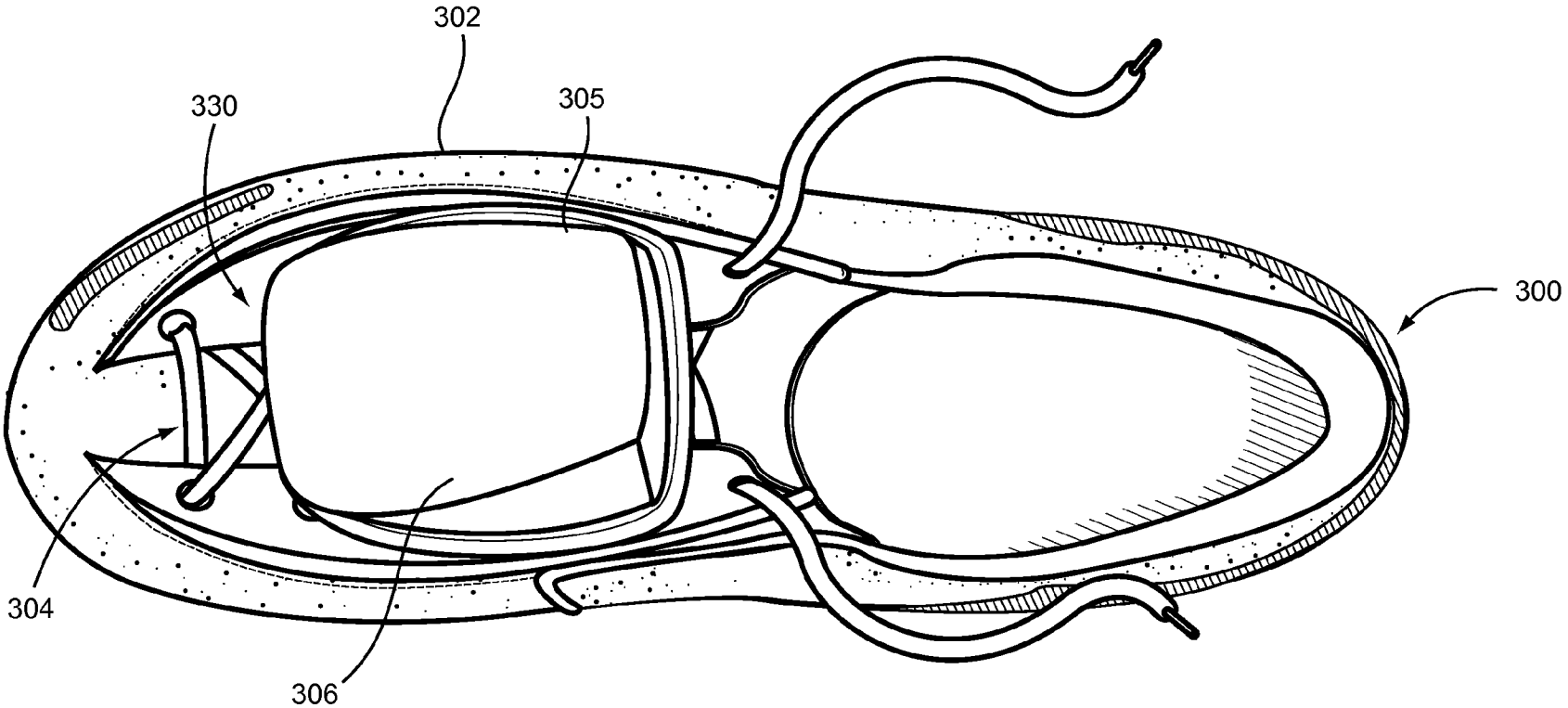
FIG. 9 is a plan view of another embodiment of an article of footwear with a ball contacting member.

In another embodiment, shown in FIGS. 8 and 9, article of footwear 300 may include upper 302 and ball contacting member 305. In some embodiments, article of footwear 300 can include lace system 304 centered on vamp portion 330 of article of footwear 300. Ball contacting member 305 may then be attached to the vamp of the footwear over the shoe fastening system by any means known in the art including, but not limited to, laces, buckles, or Velcro®.

Referring to FIGS. 8 and 9, ball contacting member 305 may be removably attached to article of footwear 300 using fasteners 320 shown on vamp portion 330 of article of footwear 300. In some cases, fasteners 320 may be hook and loop type fasteners that engage corresponding hook and look fasteners on lower surface 308 of ball contacting member 305. With this arrangement, ball contacting member 305 can be removably fastened to article 300 so that upper surface 306 of ball contacting member 305 is facing outwardly from upper 302.

Referring to FIG. 9, the current embodiment illustrates an embodiment of ball contacting member 305 that does not include any gripping members. Instead, ball contacting member 305 has a substantially smooth upper surface 306. Although the current embodiment does not include gripping members, in other embodiments gripping members could be included.

Figure 10:
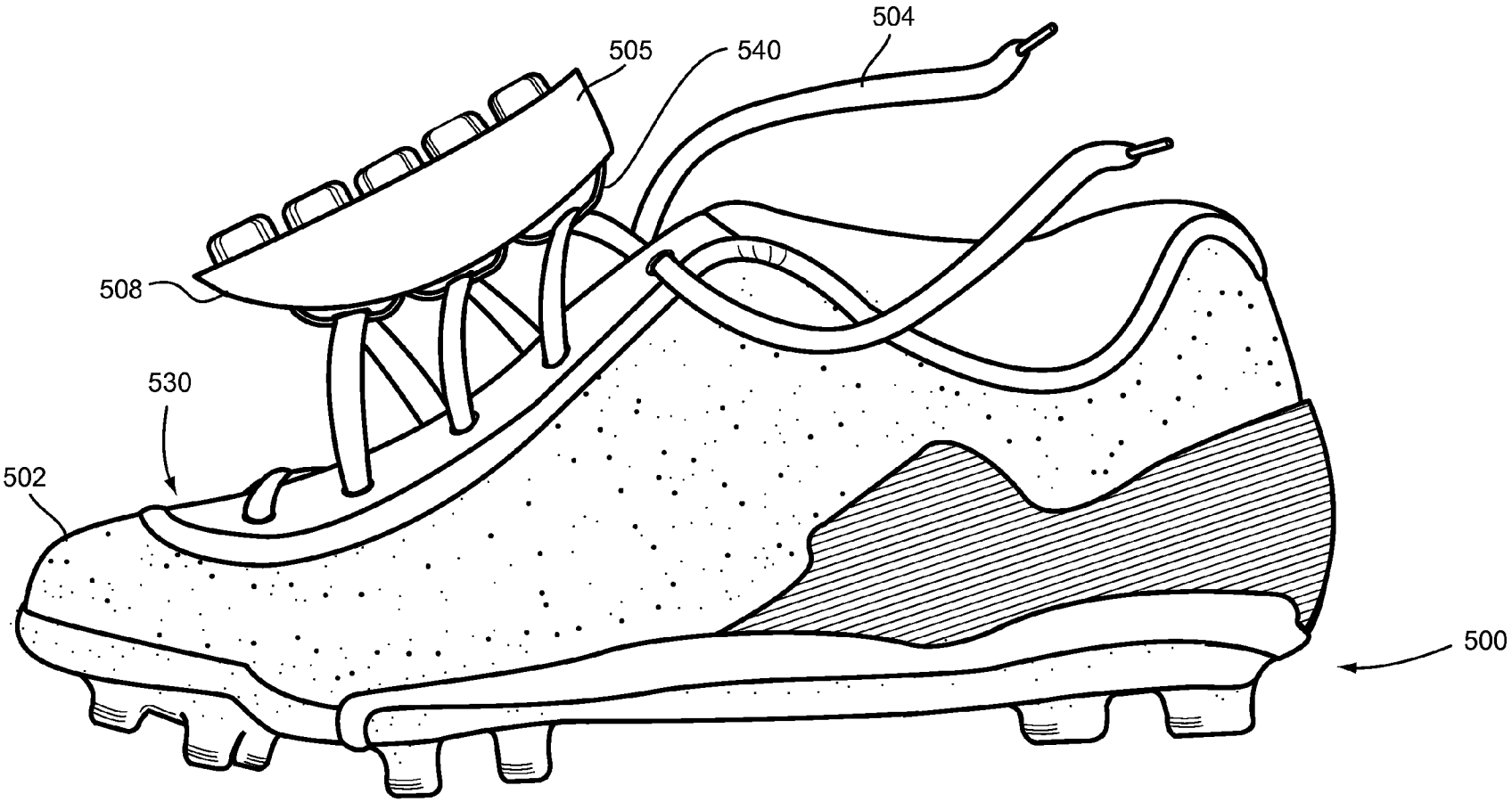
FIG. 10 is a side view of another embodiment of an article of footwear with a ball contacting member.

Referring now to FIG. 10, another embodiment of article 500 is shown. In this case, article 500 may be substantially similar to the embodiment of article 100 discussed previously. In this embodiment, article 500 may be associated with ball contacting member 505. Furthermore, ball contacting member 505 may have loops 540 on lower surface 508 through which laces 504 may be inserted to hold ball contacting member 505 in place. With this configuration, ball contacting member 505 may be fastened tightly to vamp portion 530 of upper 502 so that a maximum amount of energy can be transferred between the foot of a user and ball contacting member 505 during a kick.

In different embodiments, the number of loops used with a ball contacting member can vary. In one embodiment, the number of loops could be one. In another embodiment, the number of loops could be between one and three. In still another embodiment, the number of loops could be greater than three. In the exemplary embodiment, loops 540 may comprise three loops configured to receive lace 504.

Generally, any materials could be used for a ball contacting member. Examples of different materials include, but are not limited to, roughened leathers, rubbers, silastics, or any synthetic or natural elastomeric material such as styrene-butadiene, or polyurethane. Furthermore, in different embodiments, gripping members provided on a ball contacting member can be made of varying materials including any of the materials used for a ball contacting member. In some cases, gripping members could be made of a substantially similar material to a ball contacting member. In other cases, gripping members could be made of a substantially different material than a ball contacting member. In some embodiments, materials that enhance gripping in wet conditions can be used with a ball contacting member and/or gripping members.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

an upper including a forefoot portion, a heel portion and a midfoot portion disposed between the forefoot portion and the heel portion;

a ball contacting member disposed on the upper of the article of footwear, the ball contacting member extending through a substantial majority of a vamp portion of the article, and including a first end portion and a second end portion, the second end portion being closer to the heel portion of the upper than the first end portion;

wherein the ball contacting member, when viewed in a longitudinal cross section of the article of footwear taken through a lateral midline of the article of footwear, increases in thickness from the first end portion to the second end portion;

wherein the ball contacting member includes an interior portion extending between an upper surface of the ball contacting member and an exterior surface of the upper and wherein the interior portion comprises a substantially continuous material from the exterior surface of the upper to the upper surface of the ball contacting member;

wherein, when viewed in the longitudinal cross section of the article of footwear taken through the lateral midline of the article of footwear, the upper surface of the ball contacting member has a concave shape with a radius of curvature approximately equal to a curvature of a ball that the article of footwear is intended to contact;

a first set of gripping members disposed on the upper surface of the ball contacting member and a second set of gripping members disposed on a toe portion of the upper; and wherein, when viewed in the longitudinal cross section of the article of footwear taken through the lateral midline of the article of footwear, the first set of gripping members is aligned with the second set of gripping members along the radius of curvature of the ball contacting member.

2. The article of footwear according to claim 1, wherein, when viewed in a first lateral cross section of the article of footwear taken through the first end portion of the ball contacting member, the upper surface of the ball contacting member is convex with respect to the upper and generally level with respect to a lower planar surface of the article of footwear; and wherein, when viewed in a second lateral cross section of the article of footwear taken through the second end portion of the ball contacting member, the exterior surface of the upper declines with respect to the lower planar surface in a direction from a medial side to a lateral side of the article of footwear, and the upper surface of the ball contacting member is convex with respect to the upper and declines with respect to the lower planar surface in the direction from the medial side to the lateral side of the article of footwear.

3. The article of footwear according to claim 1, wherein, when viewed in a first lateral cross section of the article of footwear taken through the first end portion of the ball contacting member, the upper surface of the ball contacting member is convex with respect to the upper and generally level with respect to a lower planar surface of the article of footwear; and wherein, when viewed in a second lateral cross section of the article of footwear taken through the second end portion of the ball contacting member, the exterior surface of the upper declines with respect to the lower planar surface in a direction from a medial side to a lateral side of the article of footwear, and the upper surface of the ball contacting member is convex with respect to the upper and generally level with respect to the lower planar surface such that the ball contacting member is thicker on the lateral side than on the medial side.

4. The article of footwear according to claim 1, wherein each gripping member of the first and second sets of gripping members has an upper surface having at least one of a roughened surface, a cut surface, a channeled surface, a grooved surface, a surface with projections, and a surface with a recess.

5. The article of footwear according to claim 1, wherein each gripping member of the first and second sets of gripping members has an outer surface feature that increases grip with the ball in comparison to a smooth outer surface.

6. The article of footwear according to claim 1, wherein the interior portion of the ball contacting member comprises material that is more rigid than the upper surface of the ball contacting member.

7. The article of footwear according to claim 1, wherein the interior portion of the ball contacting member comprises a material that is less rigid than the upper surface of the ball contacting member.

8. An article of footwear, comprising:

an upper including a toe portion and an exterior surface at a vamp portion of the article footwear;

a ball contacting member in contact with the exterior surface of the upper and including an upper surface;

a lower planar surface that is approximately parallel with a lower surface of the article of footwear;

the upper surface of the ball contacting member being inclined, in a heel direction toward a heel portion of the article footwear, at a first angle with respect to the lower planar surface;

the exterior surface of the upper being inclined, in the heel direction, at a second angle with respect to the lower planar surface;

wherein an upper surface of the toe portion of the upper is positioned at a third angle with respect to the lower planar surface;

wherein the first angle is substantially greater than the second angle;

wherein the second angle is greater than the third angle;

a first set of gripping members disposed on the upper surface of the ball contacting member;

a second set of gripping members disposed on the upper surface of the toe portion;

wherein when viewed in a longitudinal cross section of the article of footwear taken through a lateral midline of the article of footwear, the first set of gripping members is aligned along the first angle and the second set of gripping members is aligned along the third angle, such that the first set of gripping members is at an angle to the second set of gripping members; and wherein when viewed in the longitudinal cross section of the article of footwear taken through the lateral midline of the article of footwear, the ball contacting member increases in thickness in the heel direction.

9. The article of footwear according to claim 8, wherein the ball contacting member is permanently attached to article of footwear.

10. The article of footwear according to claim 8, wherein the ball contacting member is removably attached to the article of footwear.

11. The article of footwear according to claim 8, wherein the ball contacting member is configured to be attached to the article of footwear using a hook and loop fastener.

12. The article of footwear according to claim 8, wherein the ball contacting member may be attached to the article of footwear using laces.

13. The article of footwear according to claim 8, wherein the ball contacting member is substantially wedge-shaped.

14. The article of footwear according to claim 8, wherein the ball contacting member comprises an interior portion and wherein the interior portion includes at least one air chamber.

15. The article of footwear according to claim 14, wherein the pressure of the at least one air chamber is greater than atmospheric pressure.

16. The article of footwear according to claim 14, wherein the pressure of the at least one air chamber can be changed.

17. An article of footwear, comprising:

a ball contacting member configured to attach to an upper of the article of footwear, the ball contacting member being disposed on an exterior surface of the upper at a vamp portion of the article of footwear;

the upper including a toe portion;

the ball contacting member including an upper surface;

a first set of gripping members disposed on the upper surface of the ball contacting member;

a second set of gripping members disposed on the toe portion of the upper;

wherein the upper surface of the ball contacting member is substantially steeper in a direction toward a heel of the article of footwear, with respect to a lower ground-contacting surface of the article of footwear, than a portion of the exterior surface underlying the ball contacting member;

wherein the ball contacting member, when viewed in a longitudinal cross section of the article of footwear taken through a lateral midline of the article of footwear, increases in thickness in the direction toward the heel of the article of footwear; and wherein the first set of gripping members of the ball contacting member is configured to contact a ball being kicked by a wearer of the article of footwear such that a trajectory of the ball kicked using the ball contacting member is lower than would be a trajectory of the ball kicked using the exterior surface of the upper.

18. The article of footwear according to claim 17, wherein the ball contacting member is substantially wedge-shaped, with the ball contacting member being thicker at an end portion disposed adjacent to an entry hole of the upper and the ball contacting member being thinner at an end portion disposed adjacent to the toe portion of the upper.

19. The article of footwear according to claim 17, wherein, when viewed in a longitudinal cross section of the article of footwear taken through a lateral midline of the article of footwear, the upper surface of the ball contacting member has a substantially concave shape with respect to the lower ground-contacting surface of the article of footwear;

wherein the concave shape has a radius of curvature approximately equal to a curvature of the ball; and wherein, when viewed in the longitudinal cross section of the article of footwear taken through the lateral midline of the article of footwear, the first set of gripping members is aligned with the second set of gripping members along the radius of curvature of the ball contacting member.

20. The article of footwear according to claim 17, wherein the upper surface of the ball contacting member has a substantially convex shape along a lateral direction of the article of footwear.

21. The article of footwear according to claim 17, wherein the upper surface of the ball contacting member has a substantially concave shape along a lateral direction of the article of footwear.

* * * * *